US005142819A

United States Patent [19]

Sung

[11] Patent Number: 5,142,819

[45] Date of Patent: Sep. 1, 1992

[54] GREENHOUSE

[76] Inventor: Hung-Tzu Sung, 1F, No. 9, Alley 12, Lane 99, Sec. 3, Kang-Ning Rd., Taipei City, Taiwan

[21] Appl. No.: 604,882

[22] Filed: Oct. 29, 1990

[51] Int. Cl.[5] ..... A47G 7/00

[52] U.S. Cl. ..... 47/40; 47/68; 52/201

[58] Field of Search ..... 47/19, 40, 82, 68, 69; 52/201

[56] References Cited

U.S. PATENT DOCUMENTS

| | | | |
|---|---|---|---|
| 1,407,447 | 2/1922 | Tompkins | 47/40 |
| 2,074,872 | 3/1937 | Thorin | 47/40 |
| 2,086,247 | 7/1937 | Thesen | 47/19 |
| 4,295,296 | 10/1981 | Kinghorn | 47/82 |

FOREIGN PATENT DOCUMENTS

| | | | |
|---|---|---|---|
| 2390897 | 1/1979 | France | 47/82 |
| 241682 | 12/1986 | German Democratic Rep. | 47/68 |
| 1279563 | 7/1985 | U.S.S.R. | 47/19 |
| 2147043 | 5/1985 | United Kingdom | 47/68 |

*Primary Examiner*—Henry E. Raduazo
*Attorney, Agent, or Firm*—Evenson, Wands, Edwards, Lenahan & McKeown

[57] ABSTRACT

A greenhouse, to be provided in a window opening, includes an enclosed housing having a first operable window pane provided on the outer side of the window opening to allow air into the enclosed housing, and a second operable window pane provided on the inner side of the window opening. The windowsill of the window opening is provided with an elongated groove to serve as a plant box to contain soil to grow plants. A watering device is mounted on the enclosed housing adjacent to the second operable window pane. The watering device includes a receptacle to contain liquid to water the plants, a watering pipe member communicated with the receptacle and extending into the plant box, and a valve to control liquid flow from the receptacle to the pipe member. A surrounding temperature control device is similarly mounted on the enclosed housing adjacent to the second operable window pane. The surrounding temperature control device detects if the immediate surrounding temperature at the plant box is between a maximum desired temperature and a minimum desired temperature. An exhaust fan is actuated to maintain the immediate surrounding temperature below the maximum desired temperature, and a heating fan is actuated to maintain the immediate surrounding temperature above the minimum desired temperature.

7 Claims, 5 Drawing Sheets

GREENHOUSE

BACKGROUND OF THE INVENTION

1. Field Of The Invention

The invention relates to a greenhouse, more particularly to a greenhouse to be mounted on a window opening.

2. Description Of The Related Art

Window gardens, or ornamental plants grown in receptacles provided in the windows of the home, are a common sight among households, especially those households located in crowded and polluted cities. Aside from making aesthetic contributions, the oxygen output of the photosynthetic reactions of the plants serves as a source of fresh air. However, since the receptacles containing the ornamental plants are merely placed on the windowsill, the ornamental plants are susceptible to damage from inclement weather conditions. Furthermore, most plants cannot survive in extremely cold temperatures, which, in temperate climates, are typical during the winter and autumn seasons.

SUMMARY OF THE INVENTION

Therefore, the objective of the present invention is to provide a greenhouse to be mounted on a window opening, said greenhouse protecting the plants from harsh weather and keeping the temperature of the plants' immediate environment within a desired temperature range, thus ensuring the growth of plants regardless of seasonal weather conditions.

Accordingly, a greenhouse of the present invention includes an enclosed housing mounted on the window opening. The enclosed housing has a first operable window pane provided on the outer side of the window opening to allow air into the enclosed housing, and a second operable window pane provided on the inner side of the window opening. The windowsill of the window opening is provided with an elongated groove to serve as a plant box to contain soil to grow plants. The plant box is accessible through the second operable window pane. A watering device is mounted on the enclosed housing adjacent to the second operable window pane. The watering device includes a receptacle to contain liquid to water the plants, a watering pipe member communicated with the receptacle and extending into the plant box, and a valve to control liquid flow from the receptacle to the pipe member. A surrounding temperature control device is similarly mounted on the enclosed housing adjacent to the second operable window pane. The surrounding temperature control device includes means for detecting if the surrounding temperature at the plant box is between a maximum desired temperature and a minimum desired temperature, a cooling means actuated by the detecting means to maintain the surrounding temperature below the maximum desired temperature, and a heating means actuated by the detecting means to maintain the surrounding temperature above the minimum desired temperature. The greenhouse further includes a plurality elongated lamps and a plurality of reflector pieces mounted inside the enclosed housing adjacent to the plant box. The elongated lamps and the reflector pieces serve as a source of artificial light for the plants.

BRIEF DESCRIPTION OF THE DRAWINGS

Other features and advantages of this invention will become apparent in the following detailed description of the preferred embodiments with reference to the accompanying drawings, in which.

DETAILED DESCRIPTION OF THE PREFERRED EMBODIMENTS

Figure 1:
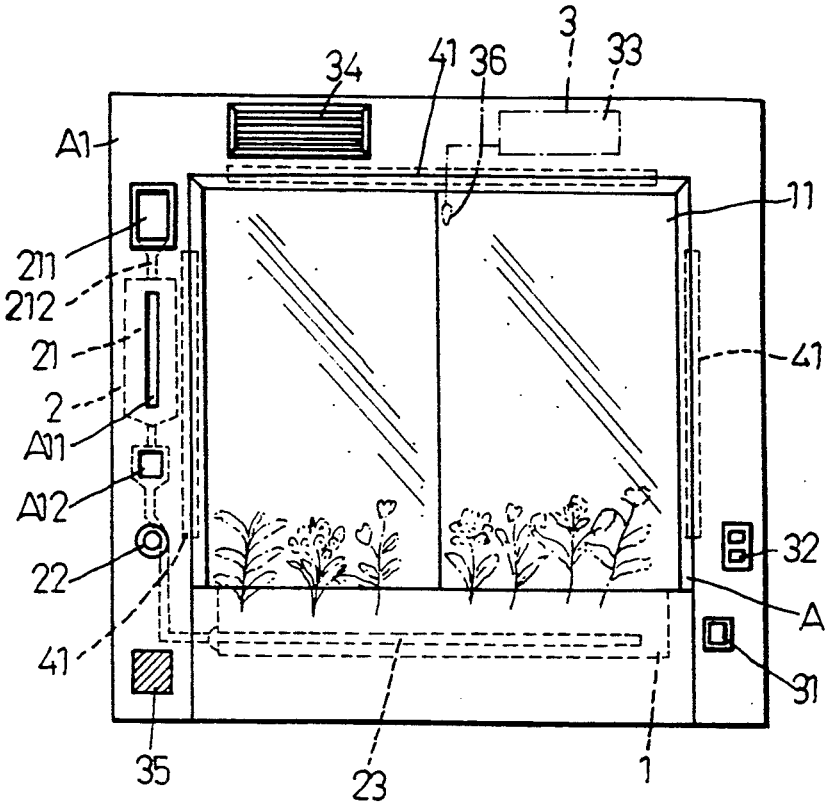
FIG. 1 is an illustration of a first preferred embodiment of a greenhouse according to the present invention when viewed from within a room.
Figure 2:
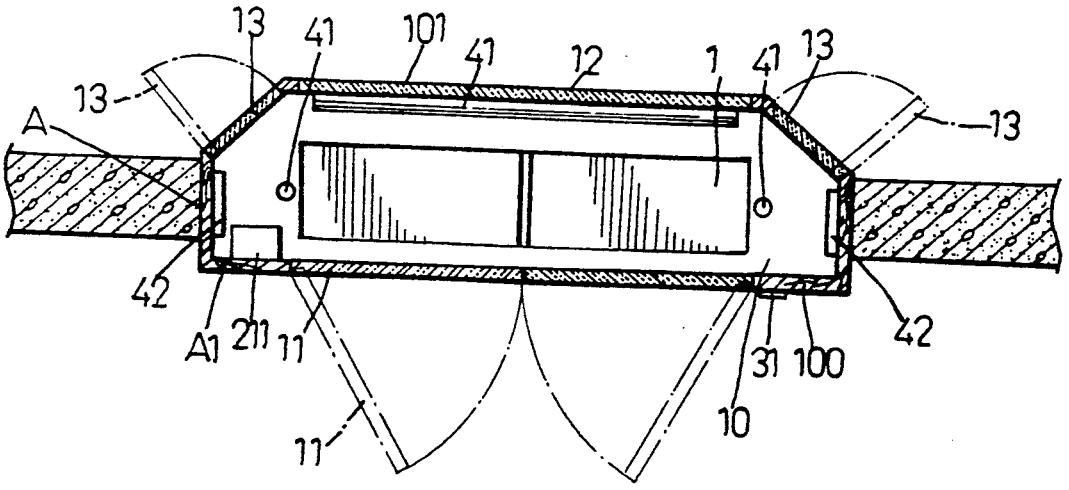
FIG. 2 is a top view of the greenhouse shown in FIG. 1.

Referring to FIGS. 1 and 2, the preferred embodiment of a greenhouse according to the present invention comprises an enclosed housing A, a plant box 1, a watering device 2, a temperature control device 3, and a lighting device.

The enclosed housing A is to be mounted on a window opening. The windowsill 10 of the window opening is provided with an elongated groove that serves as the plant box 1. The plant box 1 is to be filled with soil so as to grow plants. The enclosed housing A includes a pair of inwardly operable window panes 11 provided on an inner side 100 of the window opening. A fixed window pane 12 is provided opposite to the window panes 11 on an outer side 101 of the window opening. The outer side 101 has two inclined sides adjacent to opposite ends of window pane 12. A pair of operable side window panes 13 are provided on the inclined sides to allow air to flow into the enclosed housing A.

Figure 3:
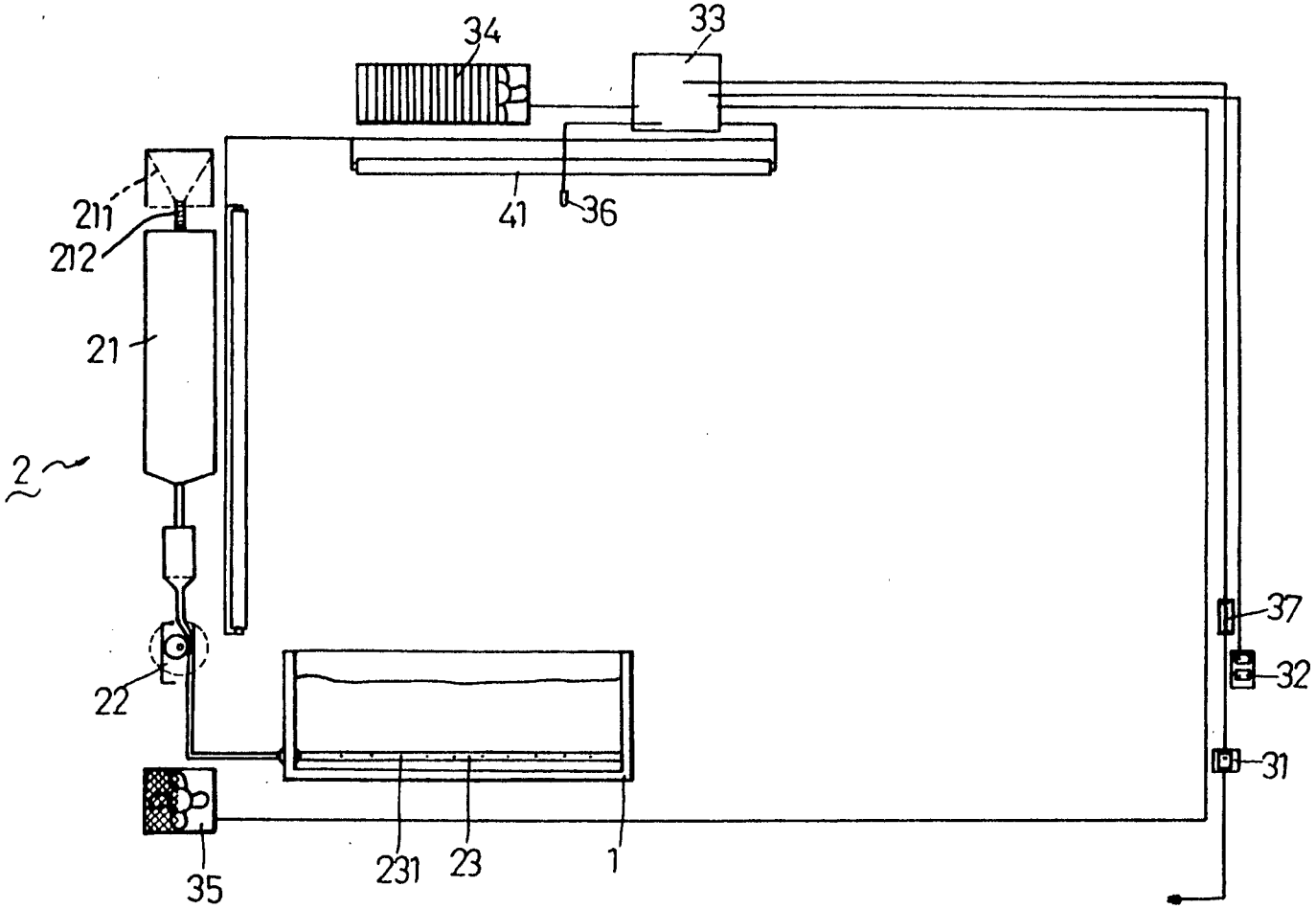
FIG. 3 illustrates the structural/electrical connection between the elements of the greenhouse shown in FIG. 1.

Referring to FIGS. 1 and 3, the watering device 2 comprises a transparent water receptacle 21, a water valve 22, and a watering pipe member 23. The water receptacle 21 is mounted on a plate member Al which is a part of the enclosed housing A and is adjacent to the window panes 11. Liquid is added to the water receptacle 21 via a container 211 which has a funnel shaped end 212. The liquid may be a nutrient solution instead of plain water so as to supplement the nutrients in the soil contained in the plant box 1. The plate member Al has an elongated opening All to serve as means for viewing the liquid content of the water receptacle 21. The water valve 22 is similarly provided on the plate member Al at the lower end of the water receptacle 21. The plate member Al has an opening A12 to serve as means for inspecting the flow of liquid to the water valve 22. The water valve 22 controls liquid flow from the water receptacle 21 to the watering pipe member 23. A perforated end 231 of the pipe member 23 extends into the plant box 1 adjacent to a bottom end of the same. This illustrates how the watering device 2 provides liquid to the plant box 1.

The temperature control device 3 includes a power supply switch 31, a fan switch 32, a thermostat control box 33, an exhaust fan 34, a heater fan 35, and a temperature sensor 36. The power supply switch 31 and the fan switch 32 are mounted on the front side of the plate member Al adjacent to the window panes 11. The thermostat control box 33 is mounted on the rear side of the plate member Al and is electrically connected to the power supply switch 31, the fan switch 32, the exhaust fan 34, the heater fan 35, and to the temperature sensor 36. A fuse 37 electrically connects the power supply switch 31 and the thermostat control box 33 to guard against overcurrent conditions. The lower end of the temperature sensor 36 is disposed above the plant box 1 so as to accurately sense the immediate surrounding temperature at the same. When the immediate surrounding temperature at the plant box 1 exceeds a maximum desired temperature, preferably set at about 29 degrees centigrade, the exhaust fan 32 is activated to lower the immediate surrounding temperature and maintain it below the maximum desired temperature. When the immediate surrounding temperature at the plant box 1 is less than the minimum desired temperature, preferably set at about 12 degrees centigrade (during autumn or winter), the heater fan 35 is activated to increase the immediate surrounding temperature and maintain it above the minimum desired temperature.

Figure 4:
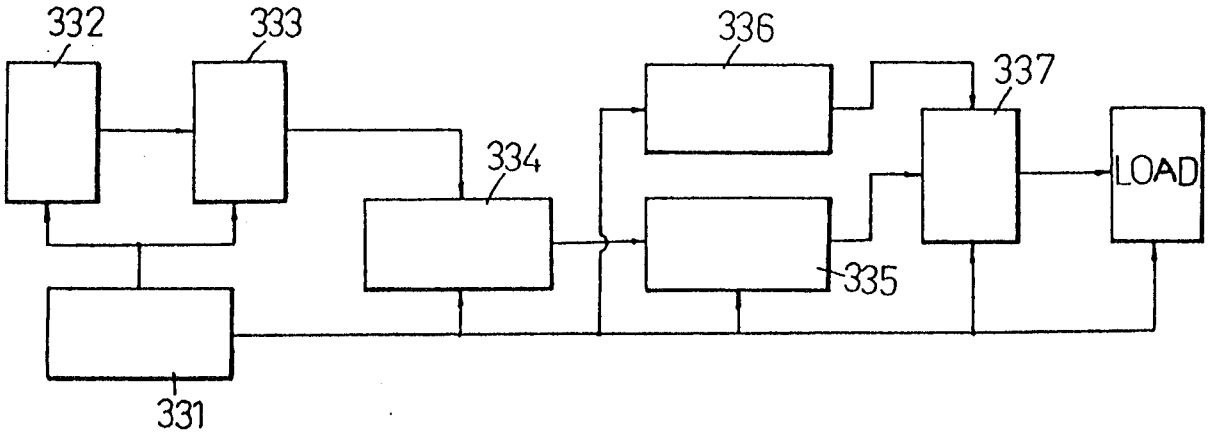
FIG. 4 is a schematic circuit block diagram of a thermostat control box of the greenhouse of the present invention.

Referring to FIG. 4, the thermostat control box 33 is shown to comprise a power supply means 331, a temperature monitoring circuit 332, a voltage amplifier circuit 333, a temperature setting control circuit 334, a signal generating circuit 335, a protective circuit 336, and a driver circuit 337. The operation of the thermostat control box 33 is as follows: The temperature monitoring circuit 332 is connected to the temperature sensor 36. When the immediate surrounding temperature is within the desired temperature range (preferably at about 12 to 29 degrees centigrade), the temperature monitoring circuit 332 sends a control signal to the temperature setting control circuit 334 via the voltage amplifier circuit 333. The temperature setting control circuit 334 decodes the control signal, and upon learning that the immediate surrounding temperature is within the desired temperature range, neither the exhaust fan 34 nor the heater fan 35 is actuated. When the immediate surrounding temperature is lower than the minimum desired temperature, the signal generating circuit 335 is actuated and the driver circuit 337 drives the heater fan 35 into operation. The heater fan 35 continues to operate until the immediate surrounding temperature is increased to fall within the desired temperature range. Accordingly, when the immediate surrounding temperature exceeds the maximum desired temperature, the driver circuit 337 drives the exhaust fan 34 into operation. The exhaust fan 34 continues to operate until the immediate surrounding temperature is within the desired temperature range. The protective circuit 336 is provided to prevent the circuit components from being damaged due to excessive current conditions. The thermostat control box 33 can also be used to control the humidity of the plants' environment and maintain the surrounding moisture level within a desired range to prolong the life of the plants.

Referring once more to FIGS. 2 and 3, the lighting device includes three elongated lamps 41 and several reflector pieces 42. The elongated lamps 41 are disposed inside the enclosed housing A adjacent to the plant box 1 and above the plant box 1 opposite to the windowsill 100. The elongated lamps 41 provide artificial light to supplement sunlight passing through the window panes 12 and 13. The elongated lamps 41 permit the photosynthetic reaction of the plants even at night or during rainy weather where sunlight is inadequate. The reflector pieces 42 are similarly provided adjacent to the plant box 1 to guarantee wider dispersion of light.

Figure 5:
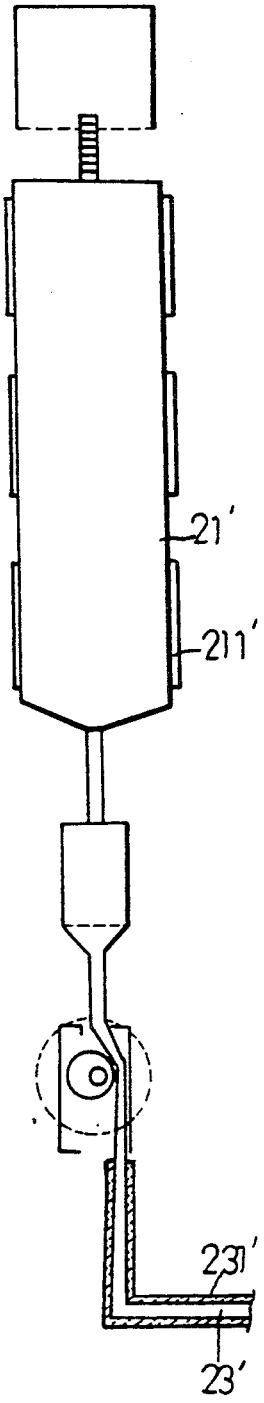
FIG. 5 is a watering device of a second preferred embodiment of a greenhouse according to the present invention.

A second preferred embodiment of the present invention is shown in FIG. 5. At areas which are farther from the equator, a heating element 211' is provided in the water receptacle 21' to prevent freezing of liquid contained in the water receptacle 21'. A portion of the pipe member 23' is wrapped in a temperature protective material 231', such as styrofoam, to similarly prevent freezing of liquid being transported to the plant box.

Figure 6:
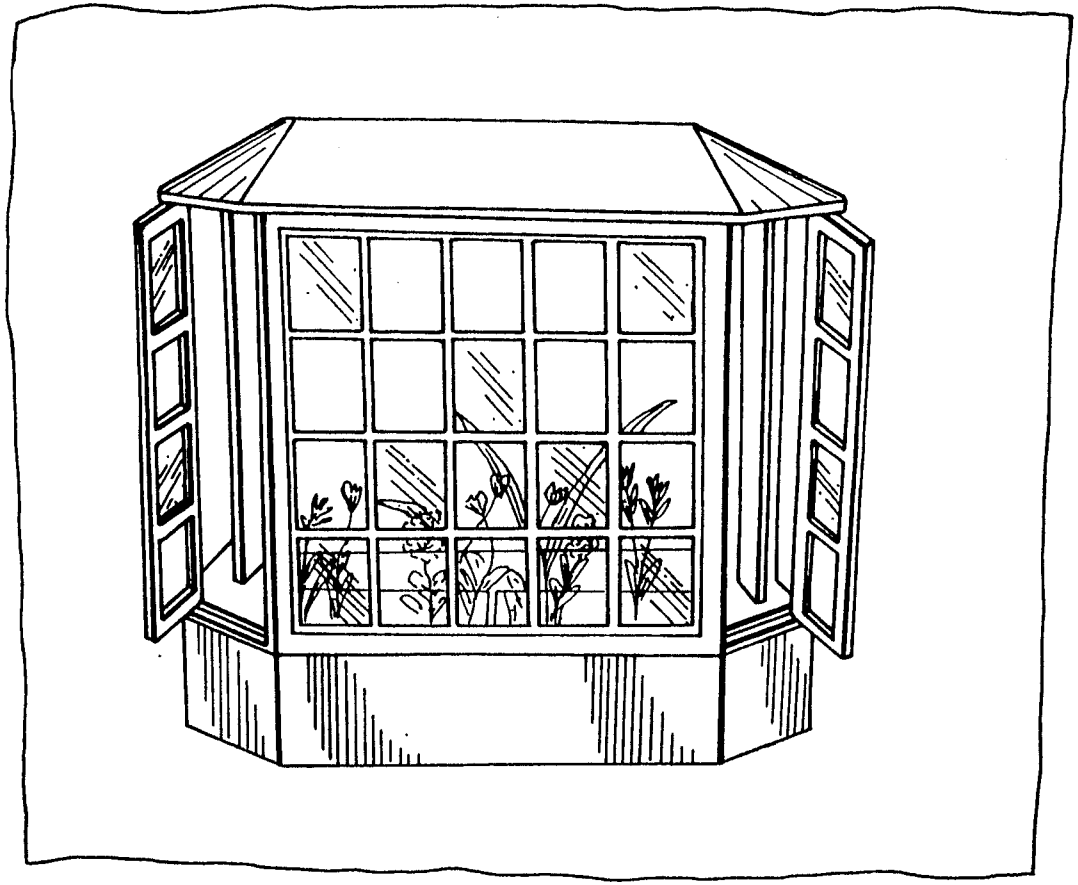
FIG. 6 is an illustration of the greenhouse of the present invention when viewed from the outside of the room.

A schematic view of the preferred embodiment is shown in FIG. 6. The window panes prevent damage to the plants because of strong winds. Aside from providing aesthetic effect, the oxygen output of the photosynthetic reactions of the plants serves as a source of fresh air.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I CLAIM:

1. A greenhouse to be provided in a window opening having a windowsill, an inner side and an outer side, comprising:

an enclosed housing mounted on said window opening, said enclosed housing having a first operable window pane provided on said outer side of said window opening to allow air into said enclosed housing, and a second operable window pane provided on said inner side of said window opening;

an elongated plant box to contain soil to grow plants, said plant box being disposed inside said enclosed housing and accessible through said second operable window pane;

a watering device mounted on said enclosed housing adjacent to said second operable window pane, said watering device including a receptacle to contain liquid to water the plants, a watering pipe member communicated with said receptacle and extending into said plant box, and a water valve to control liquid flow from said receptacle to said pipe member; and a surrounding temperature control device similarly mounted on said enclosed housing adjacent to said second operable window pane, said surrounding temperature control device including means for detecting if the immediate surrounding temperature at said plant box is between a maximum desired temperature and a minimum desired temperature, a cooling means actuated by said detecting means to maintain the immediate surrounding temperature below the maximum desired temperature, and a heating means actuated by said detecting means to maintain the immediate surrounding temperature above the minimum desired temperature.

2. The greenhouse as claimed in claim 1, further comprising means for providing artificial light to the plants, said lighting means being mounted inside said enclosed housing.

3. The greenhouse as claimed in claim 1, wherein said cooling means comprises an exhaust fan and said heating means comprises a heating fan.

4. The greenhouse as claimed in claim 1, further comprising a second heating means disposed inside said receptacle to prevent freezing of liquid contained in said receptacle.

5. The greenhouse as claimed in claim 2, wherein said lighting means comprises a plurality elongated lamps mounted inside said enclosed housing adjacent to said plant box, and a plurality of reflector pieces similarly mounted inside said enclosed housing adjacent to said plant box.

6. The greenhouse as claimed in claim 1, wherein said windowsill has an elongated groove to serve as said plant box.

7. The greenhouse as claimed in claim 1, wherein said minimum desired temperature is at about 12 degrees centigrade and said maximum desired temperature is at about 29 degrees centigrade.

* * * * *